United States Patent [19]

Gassner

[11] 4,391,457

[45] Jul. 5, 1983

[54] COMBINATION POCKET PAD AND WRITING INSTRUMENT HOLDER

[76] Inventor: Paul B. Gassner, 0405 SW. Texas St., Portland, Oreg. 97219

[21] Appl. No.: 289,470

[22] Filed: Aug. 3, 1981

[51] Int. Cl.[3] ..... B42D 3/06; B42D 3/12

[52] U.S. Cl. ..... 281/31; 24/10 R; 206/38; 206/214; 281/45; 281/49; 428/100

[58] Field of Search ..... 40/16.6; 46/124; 281/45, 49, 15 B, 19 R, 30, 31, 32, 33; 24/67.3, 67.9, 67.11, 10 R; 248/451, 452; 150/38–39; 206/805, 38, 214; 428/99, 100

[56] References Cited

U.S. PATENT DOCUMENTS

| | | | |
|---|---|---|---|
| 597,481 | 1/1898 | Graham | 281/31 X |
| 672,723 | 4/1901 | Vernon | 281/30 |
| 708,525 | 9/1902 | Buskirk | 281/31 |
| 1,039,296 | 9/1912 | Krumming | 281/45 X |
| 1,097,619 | 5/1914 | Fuller | 281/30 |
| 1,308,336 | 7/1919 | Creek | 281/30 |
| 1,524,647 | 2/1925 | Albrecht | 281/31 |
| 1,663,120 | 3/1928 | Cosper | 281/45 |
| 2,383,858 | 8/1945 | Harris | 281/45 X |
| 2,450,558 | 10/1948 | Ogren | 281/45 X |
| 2,486,840 | 11/1949 | Harris | 281/15 B |
| 2,516,809 | 7/1950 | Soderberg | 281/33 |
| 2,600,533 | 6/1952 | Harris | 281/45 X |
| 2,828,975 | 4/1958 | Wright | D3/56 X |
| 2,828,975 | 4/1958 | Wright | 281/19 R |
| 3,466,774 | 9/1969 | Borresen | 428/100 X |
| 4,244,660 | 1/1981 | Aronson | 281/45 X |
| 4,306,737 | 12/1981 | Errichiello | 281/32 |

*Primary Examiner*—Henry F. Epstein

*Attorney, Agent, or Firm*—Klarquist, Sparkman, Campbell, Leigh, Whinston & Dellett

[57] ABSTRACT

A memo or check pad holder is disclosed which is designed to fit into an open shirt pocket and retain not only a memo or check pad but also writing instruments. The holder includes a cover foldable along a flexible hinge into front and back cover sections. The inside face of said one cover section includes means for retaining a memo or check pad. The opposite outer face of the same cover section includes high friction material designed to frictionally engage the inside fabric of an open pocket to resist removal from the pocket. The inside face of the opposite cover section includes parallel spacer ribs extending along the inside face of the other cover section so that when the two cover sections are folded together the spacer ribs define a spacer pocket for receiving writing instruments clipped to a free edge of the same cover section extending generally parallel to the ribs. The ribs also prevent sideways slippage of the writing instruments from the cover section.

6 Claims, 7 Drawing Figures

COMBINATION POCKET PAD AND WRITING INSTRUMENT HOLDER

BACKGROUND OF THE INVENTION

The present invention relates to a foldable pocket memo, note or check pad holder, and more particularly to such a holder for retaining both a pad of paper sheets and writing instruments, while at the same time resisting gravity induced accidental slippage of the holder from an open pocket.

A common problem with pens and pencils equipped with clips for clipping them to a shirt pocket is that the pens and pencils slip from the pocket and fall to the ground, frequently damaging the same, when bending over.

A second common problem is that small memo pads or check books, when placed in an open shirt or coat pocket, also tend to fall out when bending over, walking fast, or running.

A third common problem is the bulk and unattractive appearance created when both a memo and check book and writing instruments are placed in an open shirt or coat pocket.

A fourth common problem is that pens and pencils clipped to a shirt or coat pocket often soil the pocket material.

A primary objective of the present invention therefore is to solve all of the foregoing problems by providing an improved combination pocket pad and writing instrument holder which resists accidental removal from an open shirt or coat pocket and protects the shirt or coat material from soiling.

SUMMARY OF THE INVENTION

In accordance with the foregoing objective, a foldable pad cover is provided with a high friction outer surface, inner spacer ribs to create a pocket between the inner faces of the two cover sections for receiving writing instruments clipped to one of the cover sections, and means for retaining a writing pad or check pad. The holder may be designed with the foldable hinge between the cover sections extending either parallel to or generally normal to the spacer ribs.

The foregoing and other objects, features and advantages of the present invention will become more apparent from the following detailed description which proceeds with reference to the accompanying drawings.

Figure 1:
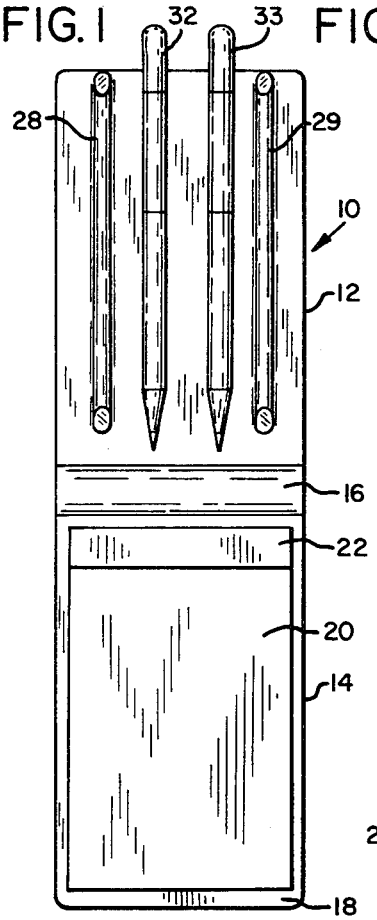
FIG. 1 is a plan view of the inside of a holder in accordance with the invention, as shown in an unfolded condition.
Figure 2:
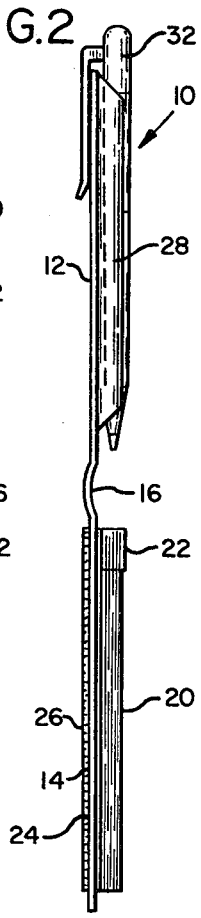
FIG. 2 is an edge view of the holder of FIG. 1.

DETAILED DESCRIPTION OF PREFERRED EMBODIMENTS FIGS. 1-5 Embodiment

Referring first to the embodiment of FIGS. 1-5, the pad and writing instrument holder in accordance with the invention includes a cover 10 including a front cover section 12 and a back cover section 14 joined together at a foldable, flexible hinge portion 16 to form a book. Typically, the cover sections and hinge portion are integrally formed of a flexible vinyl material such as is commonly used for check book covers or folders. The inside face 18 of the rear cover section 14 has retention means for retaining a memo or check book pad 20 with the bound margin 22 of the pad extending parallel to the hinge portion 16. The retention means may be, for example, the means commonly used in check book covers comprising a pocket for receiving the semirigid backing sheet of the memo pad or check pad, or could be simply a strip of pressure sensitive adhesive for retaining the bound margin 22 of the pad 20.

Figure 3:
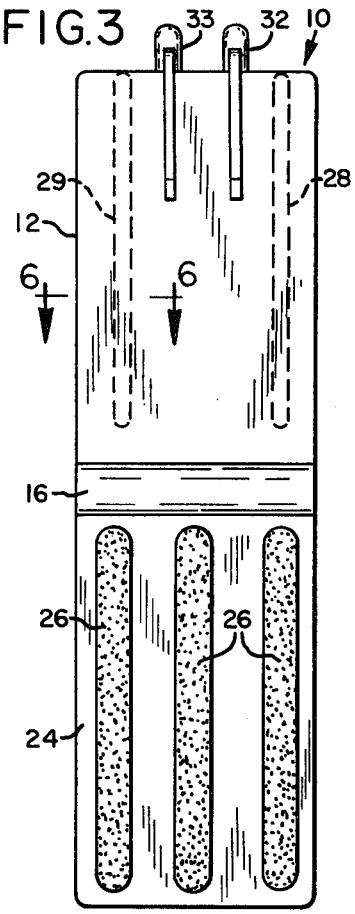
FIG. 3 is a plan view of the outside of the cover of FIG. 1, also in an unfolded condition.
Figure 4:
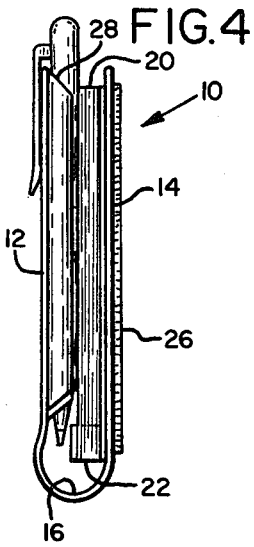
FIG. 4 is an edge view similar to FIG. 2 but showing the holder in a folded condition.

The outer face 24 of the rear cover section 14 includes gripping means for resisting accidental gravity-induced slippage of the folded cover from a shirt or coat pocket when bending over. Such gripping means as shown in FIG. 3 comprises three strips 26 of a high friction material, such as a Velcro type self-fastening tape. However, it should be appreciated that the outer face of the back cover could comprise any other high friction material, either in its entirety or in strips. The strips could also extend parallel, rather than normal, to the hinge portion 16. In any case, it will be seen that when the cover is in a folded condition as shown in FIGS. 4 and 5, the high friction material 26 will be pressed against the body side of the wearer's open pocket to tend to grip the shirt or coat material forming the back of the pocket and thereby resist slippage of the cover from the pocket when bending over, walking fast, or running.

Spacer means are provided adjacent the opposite side edges of the inside face of the front cover section 12. In the preferred embodiment shown, the spacer means comprise a pair of parallel ribs 28, 29 spaced inwardly of the side edges of front cover 12 and laterally outwardly of the center portion of such cover so as to overlie the pad 20 and create a pocket 30 when the two cover sections are folded together. The pocket 30 defined by the ribs and cover sections, best shown in FIG. 5, receives writing instruments, such as the pencils 32, 33 shown.

Figure 6:
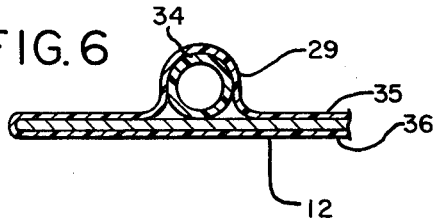
FIG. 6 is a cross-sectional view taken along the line 6—6 of FIG. 3.

As shown in the detailed view of FIG. 6, the ribs 28, 29 may be conveniently formed through the use of relatively rigid plastic tubing sections 34 inserted between two layers 35, 36 of vinyl forming the front cover section 12, with the layer 35 forming the inside face and the layer 36 forming the outside face of such cover section. The tubing sections 34 then may be heat sealed in place to stabilize their positions.

Figure 5:
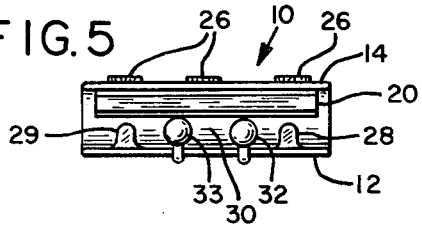
FIG. 5 is a top end view of the holder of FIG. 1 in a folded condition.

As shown best in FIGS. 1 and 5, it is important that the ribs 28, 29 be spaced inwardly from the side edges of the front cover a distance A sufficient such that the ribs will overlie the memo pad 20 and create the pocket 30 for receiving the writing instruments 32, 33 when the front and back covers are folded together.

The ribs are not only important in forming the inside pocket 30, they are also important in creating stops to prevent the writing instruments 32, 33 from slipping laterally from the cover 12.

It is also important that the lengths of the front and back covers 12, 14 be such that the point of a pen or pencil will normally terminate short of the fold or hinge 16 when the two covers are folded together so as not to break the pencil point or damage the pen point.

In the illustrated version of the holder, it will be noted that the holder should be inserted hinge first into an open pocket with the friction surfaces facing the rear panel of the pocket and the wearer's body, thereby providing a smooth entry into the pocket and resisting accidental removal therefrom. Also, it will be noted that the hinge provides a shield to prevent a pen or pencil point from marking the material of the shirt or coat pocket.

FIG. 7 Embodiment

Figure 7:
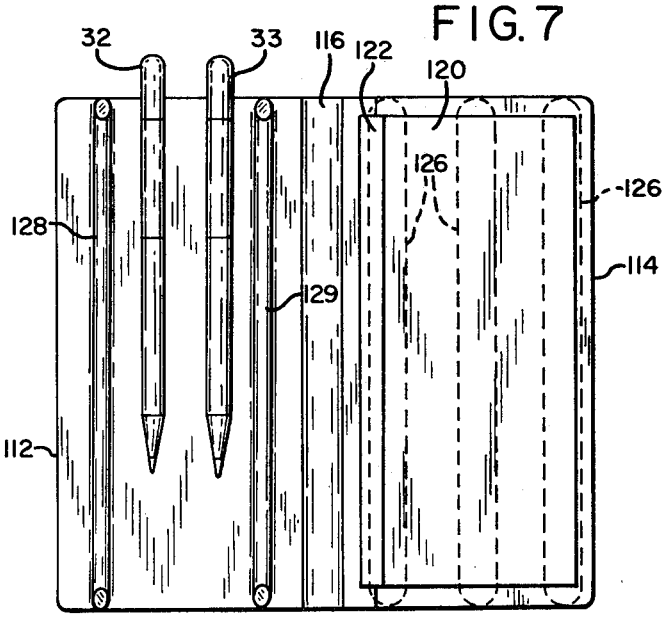
FIG. 7 is a plan view of a second embodiment of the invention showing the inside of the holder in an unfolded condition.

A second embodiment of the invention is shown in FIG. 7. Such embodiment is characterized by a side fold or hinge 116 rather than the bottom hinge of the FIG. 1 embodiment. As a result, the ribs 128, 129 on the inside face of the front cover 112 parallel the hinge 116, rather than being normal to such hinge as in the FIG. 1 embodiment.

Similarly, in the FIG. 7 embodiment the bound margin 122 of the pad 120 parallels the hinge 116. The friction strips 126 on the outside face of the back cover 114 serve the same function as the similar strips on the FIG. 1 embodiment.

The inside rib 129 of the front cover 112 should be spaced a sufficient distance from the free marginal side edge of the front cover 112 so that when the front cover is folded over the back cover, the rib 128 overlies the face of the pad 120 to create the inside pocket for the writing instruments as previously described with reference to the FIG. 1 embodiment. In addition, rib 129 should be spaced a sufficient distance outwardly from the center fold or hinge 116 so that when the front cover is folded over the back cover, rib 129 also overlies the face of pad 120 but at a position beyond the bound margin or casing 122 of the pad, so as to minimize bulk.

Having illustrated and described the principles of my invention by what are presently preferred embodiments, it should be apparent to those skilled in the art that my invention may be modified in arrangement and detail without departing from such principles. I claim as my invention all such modifications as come within the true spirit and scope of the following claims.

What is claimed is:

1. A book-type combination pocket pad and writing instrument holder comprising:

a cover foldable into front and back cover sections along a hinge portion, retention means along an inside face of one said cover section for retaining a pad of paper sheets, slip inhibiting means on the outside face of said one cover section for frictional contact with the material of an open pocket for resisting gravity-induced sliding movement of said cover from said pocket yet allowing easy manual removal of said cover from said open pocket, said slip inhibiting means comprising a high friction surface, spacer means projecting from an inside face of the other said cover section toward the inside face of the one said cover section when said sections are folded together to space the cover sections one from the other, said spacer means comprising a pair of laterally spaced apart relatively rigid parallel ribs integral with said other cover section and spaced inwardly of opposite side edge portions of said other cover section in positions overlying said pad when said cover sections are folded together, said ribs being positioned laterally on opposite sides of a center portion of said other cover section so as to define with the inside faces of said cover sections a rigid pocket therebetween when said cover sections are folded together for receiving writing instruments clipped to said other cover section and extending along the inside face thereof.

2. A device according to claim 1, wherein said pair of ribs extend generally parallel to said hinge portions.

3. A device according to claim 1, wherein said pair of ribs extend generally normal to said hinge portion.

4. A device according to claim 1 including a pad of paper sheets held to the inside face of said one cover section by said retention means with the pad having a binding margin extending parallel to said hinge portion, said ribs extending generally normal to said hinge portion and within the opposite side margins of said pad.

5. A device according to claim 1 including a pad of paper sheets held to the inside face of said one cover section by said retention means with the pad having a binding margin extending generally parallel to said hinge portion, said ribs extending generally parallel to said hinge portion and within the opposite side margins of said pad.

6. A device according to claim 1, wherein said high friction surface comprises strips of high friction material extending along an outer face of said one cover section.

* * * * *